US008256714B2

(12) United States Patent
Zhao

(10) Patent No.: US 8,256,714 B2
(45) Date of Patent: Sep. 4, 2012

(54) MODULARIZED AIRPLANE STRUCTURES AND METHODS

(76) Inventor: Jie Zhao, Midlothian, VA (US)

( * ) Notice: Subject to any disclaimer, the term of this patent is extended or adjusted under 35 U.S.C. 154(b) by 1158 days.

(21) Appl. No.: 12/074,737

(22) Filed: Mar. 6, 2008

(65) Prior Publication Data

US 2008/0217470 A1 Sep. 11, 2008

Related U.S. Application Data

(60) Provisional application No. 60/905,480, filed on Mar. 7, 2007.

(51) Int. Cl.
*B64C 1/00* (2006.01)
*B64C 13/28* (2006.01)

(52) U.S. Cl. ..... 244/120; 244/13; 244/99.3; 446/57

(58) Field of Classification Search ..... 244/13, 244/99.2, 99.3, 119, 120; 446/57, 58, 230, 446/232

See application file for complete search history.

(56) References Cited

U.S. PATENT DOCUMENTS

| | | | | |
|---|---|---|---|---|
| 2,462,462 | A * | 2/1949 | Boggs et al. | 244/2 |
| 2,504,422 | A * | 4/1950 | Hawkins, Jr. et al. | 244/74 |
| 3,017,137 | A * | 1/1962 | Helmke et al. | 244/2 |
| 3,640,492 | A | 2/1972 | Star | |
| 3,669,385 | A * | 6/1972 | Glantz et al. | 244/13 |
| 3,777,420 | A | 12/1973 | Bosley et al. | |
| 4,358,072 | A * | 11/1982 | Williamson | 244/2 |
| 4,406,085 | A | 9/1983 | Rhodes | |
| 4,417,708 | A | 11/1983 | Negri | |
| 4,537,373 | A * | 8/1985 | Butts | 244/22 |
| 5,045,013 | A * | 9/1991 | Fujitani | 446/179 |
| 5,046,979 | A | 9/1991 | Ragan et al. | |
| 5,078,638 | A | 1/1992 | Molina | |
| 5,899,064 | A * | 5/1999 | Cheung | 60/406 |
| 6,056,237 | A * | 5/2000 | Woodland | 244/3.15 |
| 6,126,113 | A | 10/2000 | Navickas | |
| 6,615,165 | B2 * | 9/2003 | Carroll | 703/3 |
| 6,726,148 | B2 * | 4/2004 | Carroll | 244/120 |
| 6,840,480 | B2 * | 1/2005 | Carroll | 244/120 |
| 6,926,235 | B2 * | 8/2005 | Ouellette et al. | 244/120 |
| 2008/0210818 | A1 * | 9/2008 | Chiu et al. | 244/120 |

FOREIGN PATENT DOCUMENTS

DE 102008023194 A1 * 12/2009

* cited by examiner

*Primary Examiner* — Joseph W Sanderson

(57) ABSTRACT

A modularized airplane includes two separably interconnected modules. A first module, incorporating substantial airplane styles, includes a fuselage portion and at least one wing or stabilizer with an associated control surface. A second module carries a set of essential flight components sufficing airplane operations, including propulsion unit, servo for moving control surface, and power source. Magnetic connectors affixed on the modules facilitate inter-modular structural connection. A control linkage assembly, linking control surface on first module and associated servo on second module, is formed with two portions longitudinally movable and separably connected by two magnetic connectors oppositely affixed on each portion. The structural connection and the servo-to-control surface linkage assembly facilitate substantially effortless inter-modular connections to form a functional airplane, as well as nondestructive inter-modular disconnection. The second module can be connected to different aerodynamic styled first modules to form airplanes for different applications, using same essential components.

11 Claims, 10 Drawing Sheets

MODULARIZED AIRPLANE STRUCTURES AND METHODS

CROSS-REFERENCE TO RELATED APPLICATIONS

This application claims the benefit of PPA Ser. No. 60/905,480, filed 2007 Mar. 7 by the present inventor.

BACKGROUND

1. Field of Invention

The present invention relates generally to modularized airplanes. More specifically, it relates to radio controlled and/or autonomously controlled modularized airplane structures and methods which enable rapid and substantially effortless inter-modular connection to form modularized airplanes, enable differing airplanes to be formed using the same set of essential airplane components, and allow nondestructive module-wise disconnection to protect the airplane modules and the components from damage in high impact events.

2. Description of Prior Art

The technology advancement in microelectronics, propulsion components, powerful lightweight batteries and new materials have enabled unmanned airplanes to be built ever lighter and smaller. Radio controlled and/or autonomously controlled airplanes of a few grams in weight and a few inches in wingspan have already become reality. Airplanes of such scale have a range of applications from sport recreation to scientific and military applications that conventional larger airplanes are unable to carry out. For an owner of such airplanes it is often desirable to have multiple airplanes of differing specifications to meet various application requirements.

Conventionally airplanes in general have been designed and constructed as integral units with fixedly-mounted components and inseparable control linkages, and each has its own designated body and essential components. For radio controlled and/or autonomously controlled airplanes the main disadvantage of the conventional construction is that it is costly to own multiple airplanes for applications of various natures due to the lack of mechanisms for conveniently sharing expensive components and structures among airplanes. Another disadvantage is its relatively high susceptibility to damages during high impact events due to its inseparable integral structure and interconnections. Yet another drawback of the conventional integral airplane construction is that it makes maintenance and repair more laborious.

Therefore, it would be advantageous for radio controlled and/or autonomously controlled airplanes to be modularized into a component module collectively carrying essential airplane components and another style-specific module incorporating substantial airplane style characteristics and aerodynamic specifications, wherein the module members are arranged to operatively and separably interconnect to one another to form a functional airplane. The component module is relatively more expensive than the style-specific module because of the essential airplane components therein, and it can be selectively integrated with differing style-specific modules to form differing airplanes, thus enabling the sharing of essential airplane components among multiple airplanes.

For airplanes that weigh a few grams the handling of the small and delicate structures and components poses challenges to untrained hands. Therefore modularized airplanes of small scale would be more practical if substantially effortless and automatic means were provided for inter-modular structural and functional connection and disconnection without involving extensive physical handling.

There have been attempts to modularize airplane structure. A simple and popular method is to render the main lifting wings structurally separate from, yet attachable to, the rest of the airplane body to form a functional airplane. This modular wing method is typically used for convenient airplane transportation and storage, and is unable to offer substantial airplane variation. U.S. Pat. No. 5,046,979 to Ragan et al. disclosed a chassis module for radio controlled airplanes to collectively mount essential components, which can be removably mounted inside the fuselages of differing airplane. However the invention lacks means for non-strenuously transferring the module from airplane to airplane, and it also lacks means for substantially effortlessly linking and delinking the airplane control linkages. U.S. Pat. No. 6,126,113 to Navickas revealed a method for modularizing helicopters, which provides the mechanism to mix differing helicopter modules into helicopters. However the processes for disintegrating and reintegrating a modular helicopter are still complex and laborious.

In view of the prior art at the time the present invention was made, while many took the advantages that the modularization concept offers, such as component sharing and maintenance accessibility, it was not obvious to those of ordinary skill in the pertinent art that a modularized airplane with connection means capable of substantially automatic and effortless inter-modular integration and disintegration is desirable, nor was it obvious how such a modularized airplane could be provided.

SUMMARY OF THE INVENTION

The general purpose of the present invention, which will be described subsequently in greater detail, is to provide a new modularized radio controlled and/or autonomously controlled airplane construction that enables effortless and substantially automatic inter-modular integration and nondestructive disintegration. Such modularized airplanes allow for swift, routine and effortless module mixing to form differing airplanes, sharing essential airplane components among differing airplanes, and improving crash damage resistance, which makes modularized airplanes, especially small modularized airplanes, highly practical and reduces the cost of owning multiple airplanes.

To attain this, the present invention generally comprises:

a style-specific airplane module having a fuselage portion, wings and stabilizers with control surfaces and incorporating substantial airplane style characteristics and aerodynamic specifications;

a shared component airplane module carrying essential airplane components including power supply units, propulsion units, control actuating devices, control-commands providing electronics units, interconnected operatively;

structural connection means having magnetic-attraction operated connection interfaces and alignment structures that enables substantially effortless inter-modular structural connection and excessive structural tension induced nondestructive inter-modular disconnection;

control linkage means having a control linkage assembly formed by two linkage portions separably connected by magnetic attraction means that facilitates substantially automatic forming of control motion transmission linkage as well as excessive-tension induced nondestructive linkage disconnection.

Upon being brought to physical proximity within the magnetic attraction range of the structural connecting means, the style-specific module and the shared-component module will structurally connect to one another by the structural connection means substantially automatically, which in turn will result in the two control linkage portions of the linkage assembly being brought to within the magnetic connecting force range, and control link connection will subsequently take place by the control linkage means substantially automatically, thus forming a structurally and functionally complete modular airplane, which allows modular disconnection and control transmission de-linking in excessive structural and transmission linkage tension situations, thus preventing airplane module and component damage, and facilitating routine substantial effortless methods for disassembling airplane.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide modularized airplane structures and methods that facilitate routine, rapid and substantially automatic inter-modular connection and disconnection to maximize efficiency and practicality for forming and unforming modularized airplanes, especially light-weight unmanned modularized airplanes.

Another object of the present invention is to provide inter-modular connection means for modularized airplanes to allow nondestructive inter-modular disconnection in situations of excessive structural stress and control linkage tension, such as airplane crash, to minimize possible structural and component damages.

Another object of the present invention is to provide a modularized airplane design enabling routine sharing of common and essential airplane components among differing airplanes to reduce costs of owning and maintaining multiple airplanes.

Another object of the present invention is to provide a modularized airplane design that allows substantial airplane style characteristics and aerodynamic specifications to be incorporated into interchangeable modules which can routinely and effortlessly integrate to a commonly shared module of essential airplane components to form airplanes for various applications.

Yet another object of the present invention is to provide a modularized airplane construction that facilitates greater structural and component accessibility for maintenance and repair.

Other objects and advantages of the present invention will become obvious to the reader and it is intended that these objects and advantages be within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

FIG. 1 is an exploded perspective view of a modularized airplane embodying the current invention.

DETAILED DESCRIPTION OF THE PREFERRED EMBODIMENTS

Figure 7:
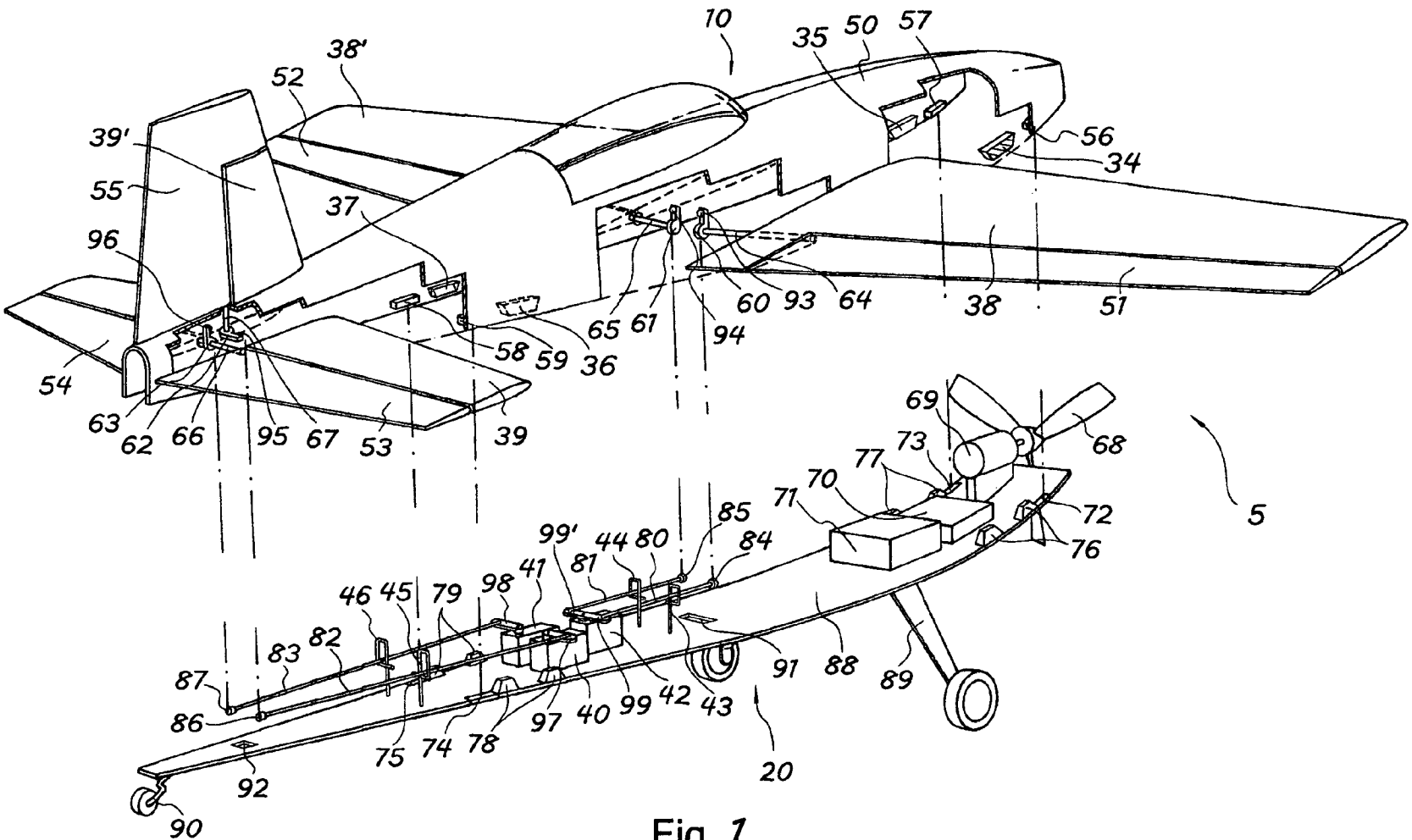
FIG. 7 is an illustrative view of a differing modularized airplane formed by the same component module in FIG. 6 interconnected with a differing character module.

Turning now descriptively to the drawings, in which similar reference characters denote similar elements throughout the several views.

Referring to the drawings, and in particular to FIGS. 1 to 3, FIG. 4A, FIG. 5A, FIG. 8 a modularized airplane according to the present invention is referenced generally by reference numeral 5 in the preferred embodiment. The modularized airplane 5 comprises an airplane style-characteristics-specific module ("character module" hereinafter), denoted 10 in FIG. 1, and a shared component module ("component module" hereinafter), denoted 20 in FIG. 1.

Figure 3:
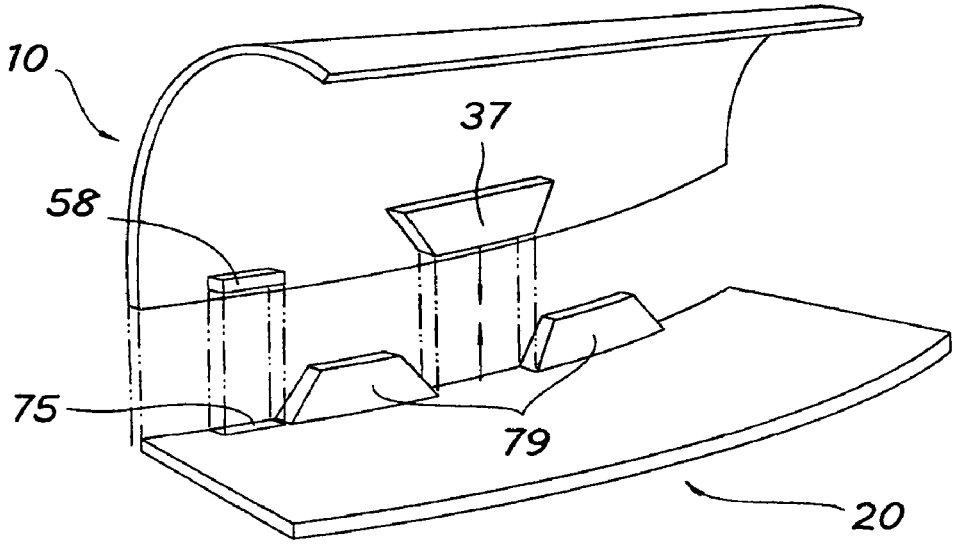
FIG. 3 is a simplified close-up perspective view of an embodiment of the inter-modular structural connection means of the current invention employed in the airplane shown in FIG. 1 and FIG. 2.
Figure 4A:
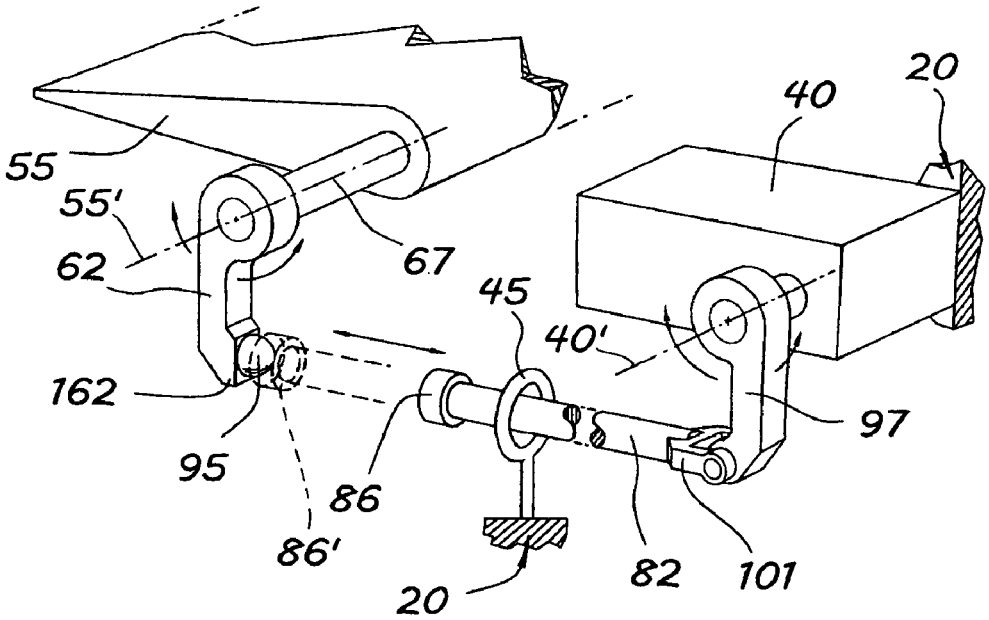
FIG. 4A is a perspective view of an embodiment of the control linkage means of the current invention employed in the airplane shown in FIG. 1 and FIG. 2. The components in this view are for illustrating the principle only and not physically identical with the components in FIG. 1 and FIG. 2
Figure 5A:
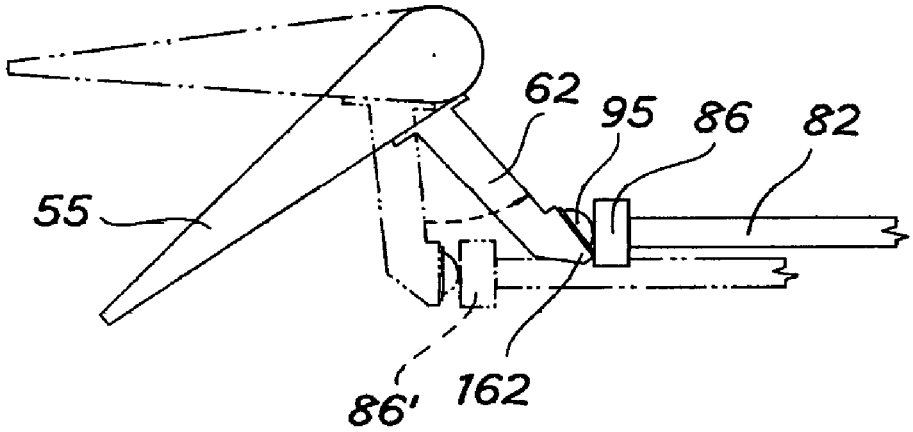
FIG. 5A is a simplified two-dimensional side view of an embodiment of the stress isolation means of the current invention as employed in the airplane shown in FIG. 1 and FIG. 2. The components in this view is for illustrating the principle only and not physically identical with the components in FIG. 1 and FIG. 2

Character module 10 comprises a fuselage portion 50, airplane wings 38, 38' and stabilizers 39, 39' conjoint to the fuselage portion, control surfaces including ailerons 51, 52, elevators 53, 54 and rudder 55 operatively attached to the wings, horizontal stabilizers and vertical stabilizer, respectively. A plurality of torque transmitting rods 64, 65, 66, 67, are fixedly joined with control surfaces 51, 52, 53, 55, respectively, transmitting rod 66 is also fixedly joined with control surface 54. A plurality of control levers 60, 61, 62, 63, are fixedly mounted on torque rods 64, 65, 66, 67 of control surfaces, respectively, for the purpose of transmitting control motion to control surfaces by control linkage means which is shown in FIGS. 4A, 5A and will be described later herein. A plurality of magnetic inter-modular structural connector members 56, 57, 58, 59 are distributed in fuselage portion 50 and affixed at selected locations. Inter-modular structural connection alignment structures 34, 35, 36, 37 are provided for assisting inter-modular structural connection by connection means which is shown in FIG. 3 and will be described in detail later in this document.

It is to be understood that the numbers, locations and configurations of wings, stabilizers, and the number of control surfaces can vary according to the airplane design, and should not be limited by the embodiment herein presented.

It is to be appreciated substantial airplane style characteristics and aerodynamic specifications can be incorporated into character module 10.

Figure 8:
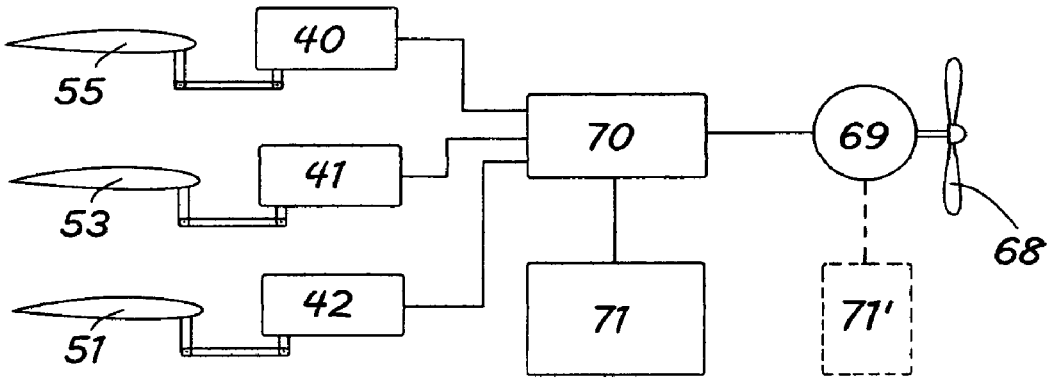
FIG. 8 is a symbolic schematic diagram of operatively interconnected airplane essential components.

Component module 20 comprises a fuselage portion 88 complementing fuselage portion 10 to form a complete airplane fuselage, essential airplane components sufficient for airplane operations including a propulsion unit having engine 69 and propeller 68, electronics unit 70 for processing remote control and/or auto-piloting signals to control on-board components, power sources 71 to provide power for onboard power consuming components, actuating devices 40, 41, 42, to provide mechanical control motion for control surfaces rudder 55, elevators 53, 54, and ailerons 51, 52, respectively, and support structures adhered to fuselage portion 88 provided for attaching essential airplane components thereto. Said essential airplane components are mounted on said support structures. In current embodiment said support structures are incorporated into the fuselage portion 88, and therefore not explicitly shown. Operative interconnection of essential airplane components, as shown in FIG. 8, are implied, but not explicitly shown in FIGS. 1 and 2.

A plurality of inter-modular structural connectors 72, 73, 74, 75, magnetically attractive to the inter-modular structural connectors 56, 57, 58, 59 of character module 10, respectively, are distributed on fuselage portion 88 and affixed at locations opposite and properly connectable to inter-modular structural connector members 56, 57, 58, 59, respectively, forming magnetically attractive connector member pairs. Inter-modular structural interface alignment structures 76, 77, 78, 79 are provided on the component module opposite to complementary structures 34, 35, 36, 37 on the character module for assisting inter-modular structural connection by connection means which is shown in FIG. 3 and will be described in detail later herein.

A plurality of control motion transmission rods 80, 81, 82, 83, have one end operatively coupled to motion output levers 99, 99', 97, 98 of servo devices 42, 40, 41, respectively. Cylindrically shaped and axially magnetized magnet elements 84, 85, 86, 87 are fixedly and coaxially attached to the free end of rods 80, 81, 82, 83, respectively, so that the free end surfaces of the magnets are perpendicular to the axes of the rods to which the magnets are attached. A plurality of control rod guide members 43, 44, 45, 46, attached to said support structure incorporated in the fuselage portion 88, each having an aperture through which the control motion transmission rods 80, 81, 82, 83 pass, respectively, provide both support and lateral movement limits for said control motion transmission rods. Optional landing gear 89, 90 are removably attached to the component module. Optional openings 91, 92 are provided on fuselage portion 88 for control coupling inspection and adjustment after module members are interconnected.

It is to be understood that the number and type of components onboard the component module should be sufficient for the types of airplane intended by the modular system, and not be limited to those embodied herein.

It is also to be understood that although not reflecting the advantages represented by this invention fins, with or without control surfaces, are not excluded by this invention in the component module embodiment.

It is to be appreciated that said support structures for attaching essential airplane components can take various forms, such as a frame mounted with essential components attached to fuselage portion 88, or fuselage portion 88 itself incorporating support structures for attaching said essential components. The specific structure, however, does not directly relate to the advantages of this invention.

The embodiment FIGS presented herein do not show interconnections among said essential components, however it is to be understood that an operatively interconnected electrical, control and power environment sufficient for normal functioning of components shown is implied. FIG. 8 illustrates operational interconnection of the essential airplane components in the form of a simplified schematic diagram.

In FIG. 3 the inter-modular structural connection means is shown in detail. It is to be understood that although said plurality of connector member pairs and said plurality of alignment structures collectively contribute to the inter-modular structural connection means it is sufficient to illustrate the operation using only one of the connector pairs 58, 75 and one section of the alignment structures 37, 79 of current embodiment.

The inter-modular structural connection means comprises a mutually magnetically attractive member pair 58, 75 oppositely affixed on opposing module members 10, 20 at predetermined locations for ensuring airplane structural and aerodynamic integrity when the module members are connected and held together by mutual magnetic attraction force. The magnetic attraction strength between members in said pair is selected to ensure the airplane's structural integrity under allowable operating conditions and also to enable nondestructive inter-modular structural disconnection under intentional or unintentional excessive structural tension situations.

An interlocking mechanism comprises physically matching structural members 37, 79 joined at or being an extension of opposing modules 10, 20, respectively. Structure member 79 forms a valley shaped opening wider at the top than at the bottom. The shape and size of structure member 37 substantially complements the valley shape and size of structure member 79. During the process of inter-modular structural connection modules 10 and 20 are brought to physical proximity where member 79 starts to accept member 37. The wider opening of the valley of member 79 provides relative position tolerance for the two approaching modules. The structure 79 provides guidance for the approach to interconnection. The matching shapes of members 37, 79 provide precise inter-modular structural connection alignment and inter-modular lateral interlocking once modules 10, 20, are structurally interconnected.

As the modules 10, 20 approach one another and reach the proximity of the range of sufficient attractive magnetic force between members 58 and 75 the subsequent inter-modular structural connection will proceed substantially automatically by the attractive magnetic force.

The magnetic attraction strength between the connector members 58 and 75 is chosen such that in the event of excessive inter-modular structural parting stress of intentional or unintentional cause, inter-modular structural disconnection will occur before the stress exceeds the maximum allowed structural stress for modules 10 and 20, resulting in nondestructive module-wise disconnection.

It is to be appreciated that the interlocking mechanism can be achieved with differing structure forms, and in cases where requirements on inter-modular structural alignment and lateral displacement are not stringent the interlocking mechanism may not be necessary.

There are four similar control linkages in current embodiment, coupling the rudder, elevator and two ailerons to the associated servo devices, respectively. A representative control linkage assembly according to current invention in current embodiment is illustrated in FIGS. 4A, 5A, and is sufficient to illustrate the principle.

Figure 2:
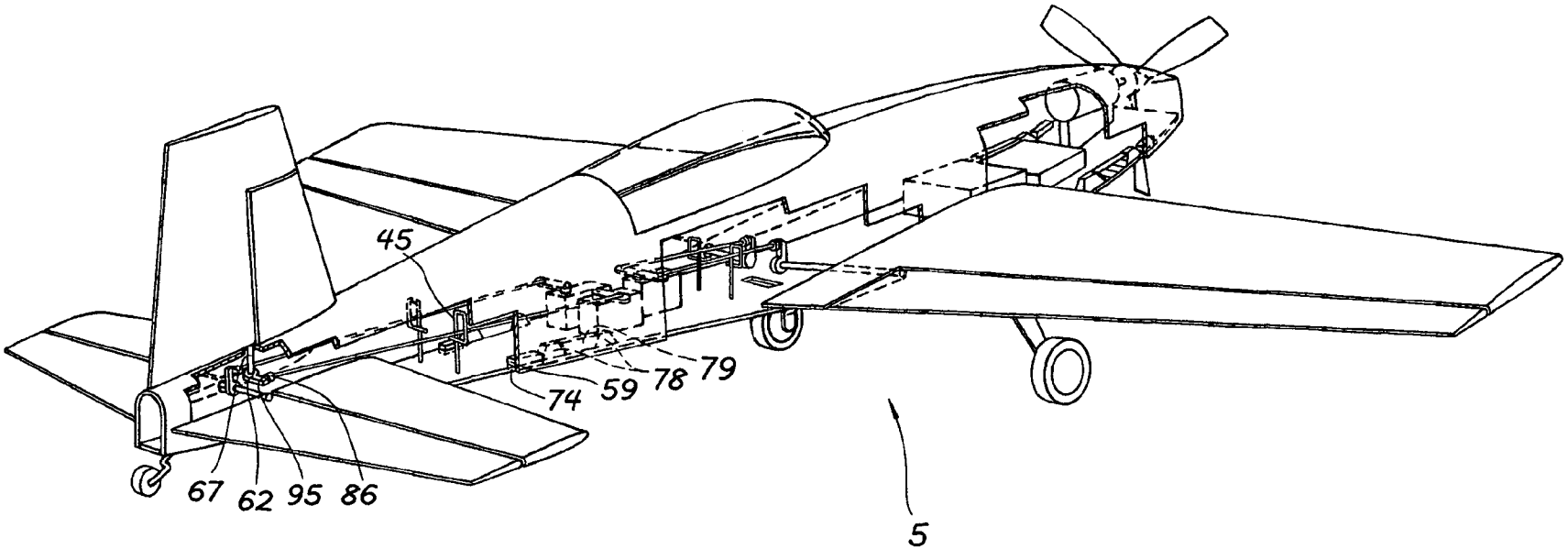
FIG. 2 is a perspective view of a modularized airplane shown in FIG. 1 with module members fully connected.

It is to be understood that the purpose of FIG. 4A is to illustrate the operation principle of the control linkage means. Although the numerical notations of the linkage between rudder 55 and associated servo device 40 in FIGS. 1, 2 are used, the illustration in FIG. 4A is not intended to scale or to be graphically identical to any of the linkage assemblies shown in FIGS. 1, 2.

As shown in FIG. 4A, the control linkage means provides control motion linkage from a servo device 40 having motion lever 97 to a control surface member 55 via a control motion linkage assembly.

Said control motion linkage assembly comprises a rod member 82 with one end operatively coupled to servo lever 97, a linkage guide member 45 secured on component module 20 and having an aperture through which the rod member 82 passes, a cylindrically shaped magnet 86 attached coaxially to the free end of rod member. The aperture of the guide member 45 defines a limited spatial orientation region for the rod 82 while not restricting the control motion transmission movement of the rod.

Said control linkage assembly further comprises a control-motion-receiving lever 62 perpendicularly affixed to a torque rod 67 extended from the control surface 55, a magnetically attractive member 95 fixedly attached to the coupling end of lever 62 extending substantially perpendicular to both the lever body 62 and the torque rod 67 toward the servo lever 97. The exposed surface of member 95 is smooth and spherical in shape.

The relative angle between lever 62 and control surface 55 is chosen such that the control surface is at neutral position when controlling servo lever 97 is at its neutral position.

When the magnetic end surface of the magnet member 86 on the rod 82 connects to the magnetic attractive member 95 on the lever 62, shown as 86' in dashed lines in FIG. 4A, the attractive magnetic force will maintain the contact so long as the linkage tension at the connection point does not exceed the magnetic attraction force. This connection means allows the lever 62 to pivot about the connecting point and therefore it allows control motion to be transmitted from the servo arm 97 through the rod 82 to the lever 62 which in turn moves the control surface, thus forming a control motion linkage. The magnetic attraction strength between the coupling members 86 and 95 is chosen to sustain the coupling linkage under allowed operation conditions.

With reference to FIG. 5A, the preferred embodiment of means for isolating the control surface from excessive pulling tension present in the control linkage is disclosed, based on the preferred control linkage embodiment shown in FIG. 4A. The lever 62 has an end portion 162 extending beyond coupling member 95 and forming a spatial relationship with coupling member 95, such that as the rod 82 is pulled in the direction away from lever 62 causing the angle between rod 82 and lever 62 to increase from the neutral position of about 90 degrees, at a certain angle the flat coupling surface of the coupling magnet 86 will be in contact with both the spherical surface of the coupling member 95 on lever 62 and the end portion 162 of the lever 62, as shown in FIG. 5A in the solid lined position, which will prevent further increase in angle without disconnecting member 86 from member 95 and therefore de-linking the control linkage. Continued pulling of the rod 82 along the same direction will cause decoupling of the linkage. This mechanism isolates and therefore protects the control surface and associated structures from excessive tension present in the control linkage.

The length of the motion transmitting rod 82 and the location of the guide member 45 are adjusted such that when airplane modules 10 and 20 are structurally interconnected the magnetic coupling member 95 on lever 62 will be able to operatively couple with the coupling magnet member 86 on the rod 82 to form a control linkage.

The size and shape of the guide aperture is adjusted to limit the rod orientation to ensure the magnetic coupling members 95 and 86 stay within sufficiently close range of one another while not restricting control motion transmission, where magnetic attraction induced coupling will occur substantially automatically when the two modules are interconnected structurally.

The main advantage of the inter-modular structural connection and control linkage means of the current invention of the modularized airplane is that the processes for inter-modular connection and disconnection can be achieved by simply placing the modules together allowing magnetic auto-connection and simply pulling the modules apart from one another, and therefore it enables swift, effortless and substantially automatic inter-modular structural connections and control linkage couplings to form a functional airplane, as well as nondestructive module-wise disconnection under excessive structural and control linkage stress situations facilitating both rapid, substantially effortless module-wise disconnection of an airplane and heightened resistance to high impact damage.

With reference to FIG. 2, a modularized airplane having module members 10 and 20 as in FIG. 1 interconnected by inter-modular connection means and control linking means according to current invention is revealed.

Referring now to FIGS. 4B to 4G, a number of alternative embodiments of control linkage means are disclosed.

Figure 4B:
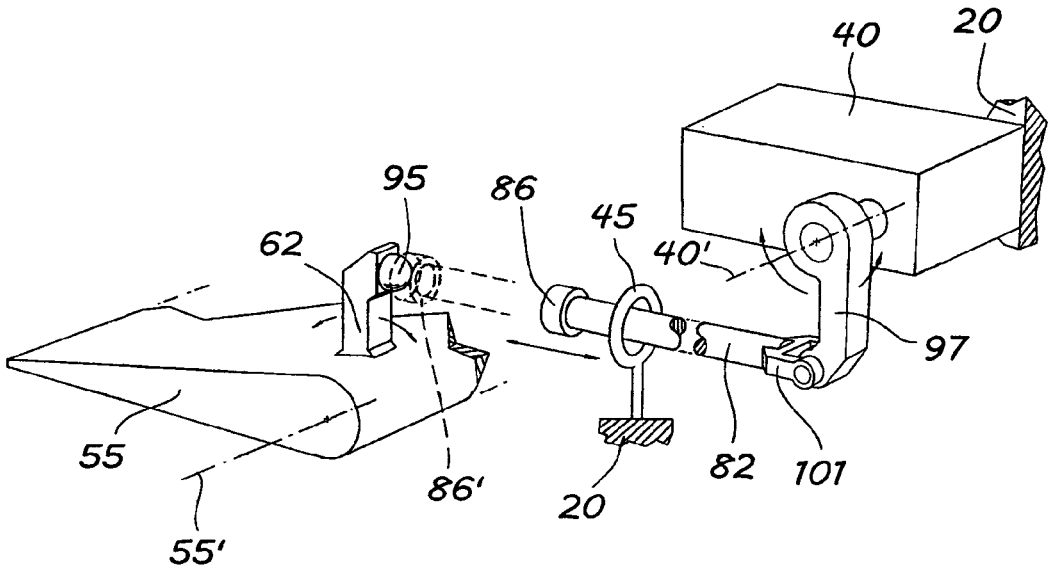
FIG. 4B-4G are perspective views of additional embodiments of the control linkage means of the current invention, for illustrating principles and not to scale.

The first alternative embodiment is illustrated in FIG. 4B, in which the control surface member 55 has no torque rod attached, and the control motion receiving lever 62 is directly mounted on the control surface.

Figure 4C:
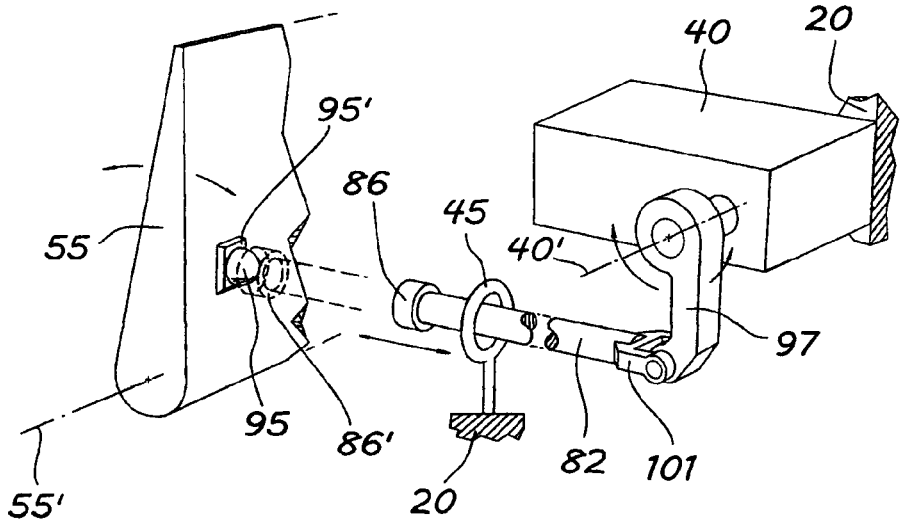

A variation of the embodiment revealed in FIG. 4B is illustrated in FIG. 4C, in which the control surface member 55 has no transmission lever, and the magnetically attractive coupler 95 is attached to a mounting structure 95' provided on the control surface 55, linking the control surface to the control rod 82 substantially perpendicularly. The distance between the coupling member 95 and the operation axis 55' of the control surface serves effectively as a lever.

Figure 4D:
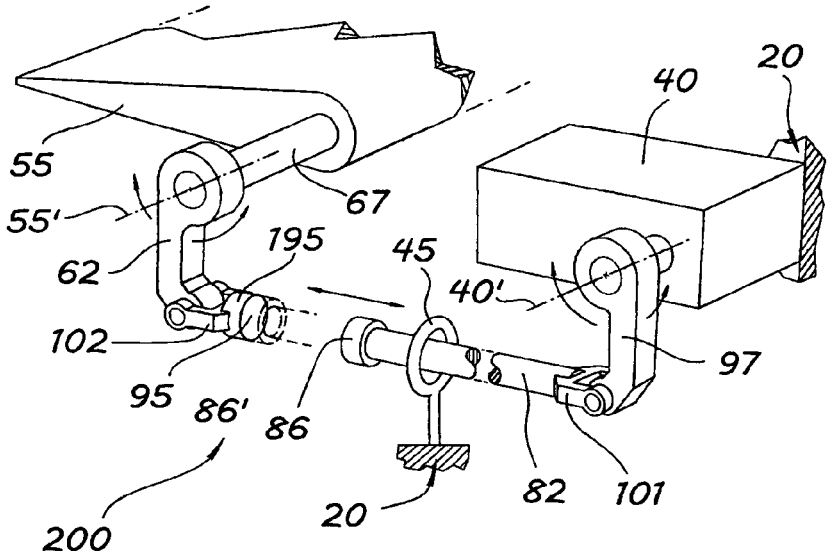

An alternative of the preferred embodiment disclosed in FIG. 4A is disclosed in FIG. 4D, in which the magnetically attractive coupling member 195 is cylindrical in shape and coaxially secured on a base member 102 which in turn is pivotally coupled to the control motion receiving lever 62.

Figure 4E:
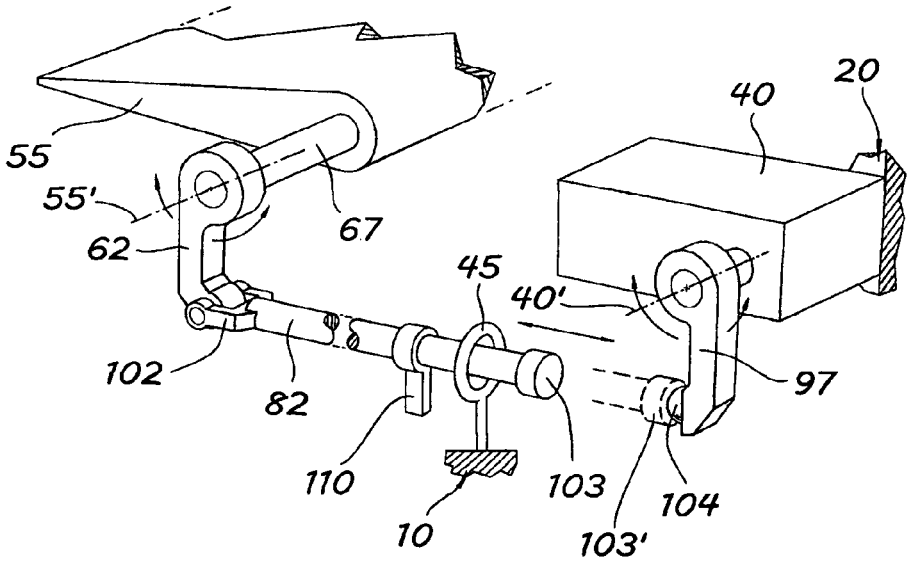

With reference to FIG. 4E, another alternative of the preferred embodiment shown in FIG. 4A is disclosed, in which the methods for linking the servo lever member 97 to the control surface lever 62 is the exact reverse of the linkage shown in FIG. 4A. An alternative embodiment for the means for isolating the control surface from excessive pulling tension, involving member 110, is shown which will be described in detail later herein. The main advantage of the alternative embodiment for the control linkage means shown in FIG. 4E is that it allows more dimensional freedom in designing the airplane style-characteristics-specific module member, denoted as character module 10 in current embodiment by varying the length of control link rod 82, now linked pivotally to control surface lever 62 by coupling end 102, as shown in FIG. 4E.

Figure 4F:
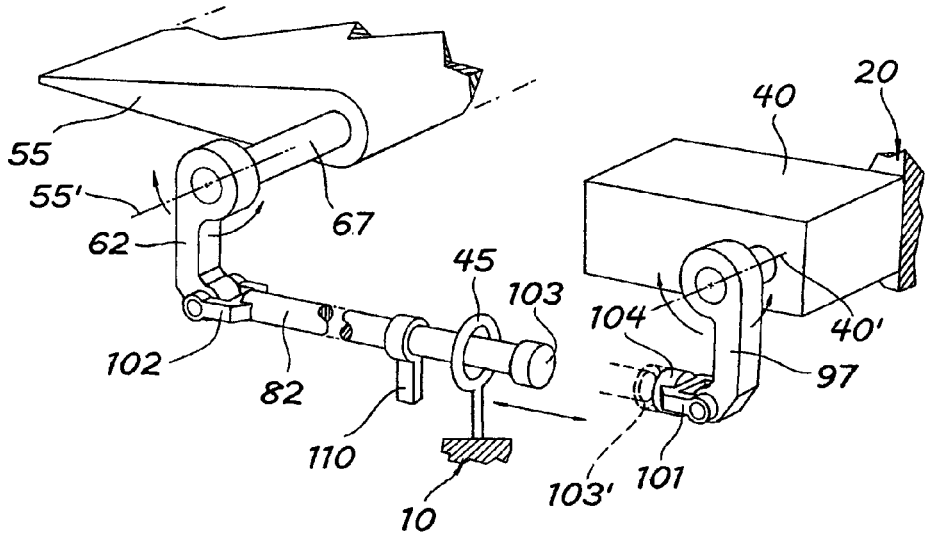

With reference to FIG. 4F, another alternative embodiment of the control linkage method is shown, in which the methods for linking the servo lever member 97 to the control surface lever 62 is the exact reverse of the linkage shown in FIG. 4D. An alternative embodiment for the means for isolating control surface from excessive pulling tension, involving member 110, is shown which will be described in detail later herein. This alternative embodiment has the same advantage as that described in the embodiment shown in FIG. 4E.

Figure 4G:
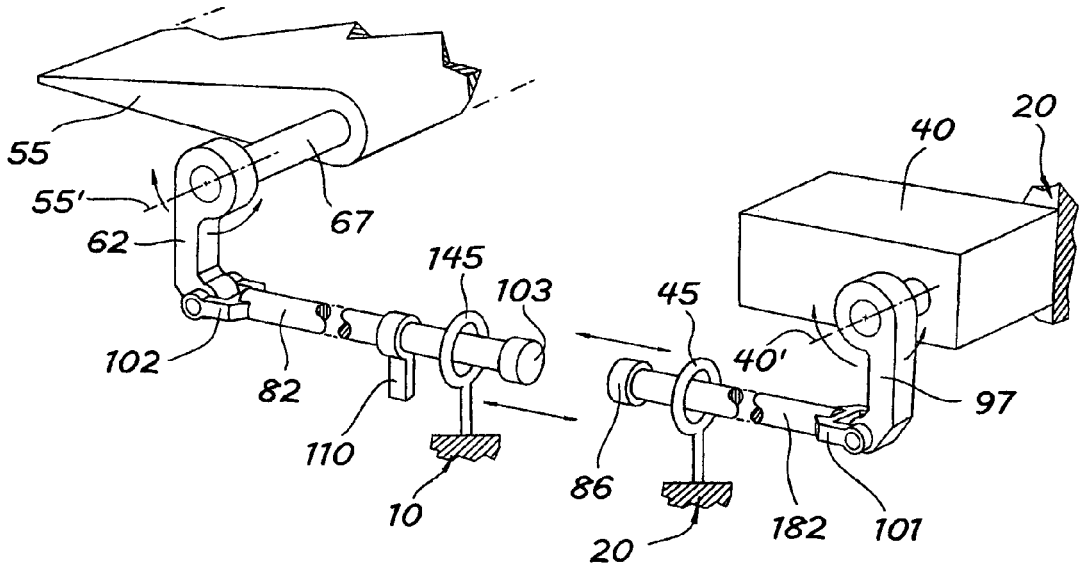

With reference to FIG. 4G, another alternative control linkage embodiment is disclosed, in which the control rod comprises two separate portions, 182 with coupling end 101 and 82 with coupling end 102, pivotally coupled to servo lever 97 and control surface lever 62, respectively. Two mutually magnetically attractive members 86, 103, cylindrical in shape, are coaxially attached at the free ends of the two control rod portions 182 and 82, respectively. Two guide members, 45 affixed on module 20 and 145 affixed on module 10, are provided to guide the two control rod portions 182 and 82, respectively. An alternative embodiment for the means for isolating the control surface from excessive pulling tension, involving member 110, is shown which will be described in detail later herein. This alternative embodiment has the same advantage as that described in the embodiment shown in FIG. 4E.

Figure 5B:
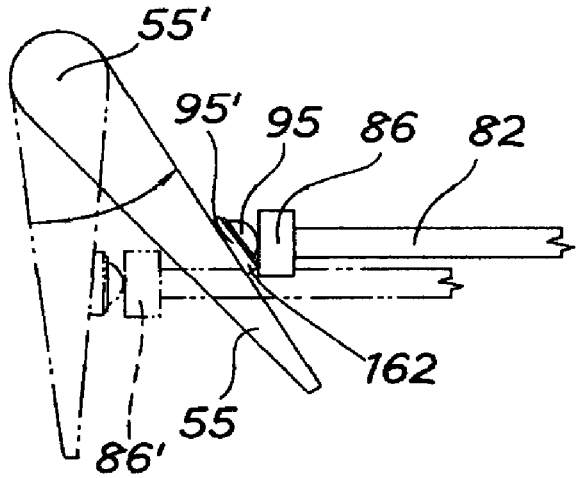
FIG. 5B-5D are simplified two-dimensional side views of additional embodiments of the stress isolation means of the current invention.
Figure 5C:
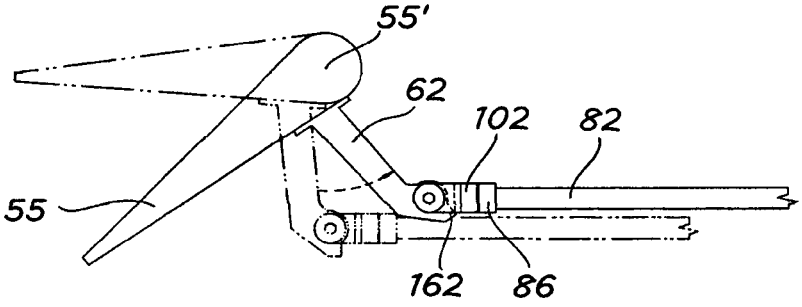
Figure 5D:
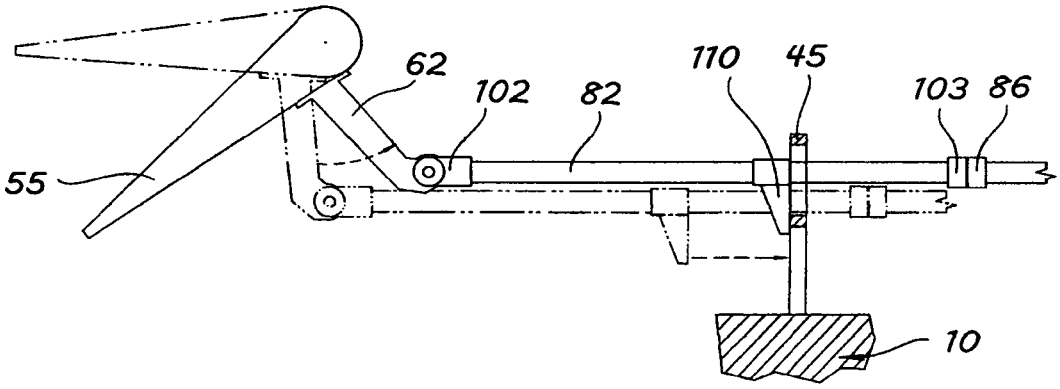

Referring now to FIGS. 5B to 5D, a number of alternative embodiment for the means for isolating the control surface from excessive pulling tension according to current invention are disclosed.

With reference to FIG. 5B, an embodiment variation of the means for isolating the control surface from excessive pulling tension shown in FIG. 5A is disclosed, the control linkage embodiment herein is based on that shown in FIG. 4C, in which the control surface 55 has no control lever, and the coupling member 95 is attached to a mounting structure 95' provided on the control surface 55 having a portion 162 extending beyond coupling member 95 in the direction away from the control surface operation axis 55'. The functional principle in this embodiment is identical to that disclosed in the embodiment shown in FIG. 5A.

With reference to FIG. 5C, an alternative embodiment of the means for isolating the control surface from excessive pulling tension present in the control linkage is disclosed, based on the control linkage embodiment disclosed in FIG. 4D. The lever 62 has an end portion 162 extending beyond the lever coupling point and forming a spatial relationship with coupling base member 102, such that as the rod 82 is pulled in the direction away from lever 62 causing the angle between rod 82 and lever 62 to increase from the neutral position of about 90 degrees, at a certain angle the coupling base member 102 will be in physical contact with the end portion 162 of the lever 62, as shown in FIG. 5C in the solid lined position, which will prevent further increase in angle without disconnecting member 86 from coupling base member 102 and therefore de-linking the control linkage. Continued pulling of the rod 82 along the same direction will cause decoupling of the linkage. This mechanism isolates and therefore protects the control surface and associated structures from excessive tension present in the control linkage.

With reference to FIG. 5D, an alternative embodiment of the means for isolating the control surface from excessive pulling tension present in the control linkage is disclosed, based on the control linkage portion from the control surface lever 62 to the member 103 in the embodiments disclosed in FIGS. 4E to 4G. A rigid structure 110 is extended transversely from a predetermined location on rod 82, impassible through the aperture in guide 45, forming a spatial relationship with the guide member 45, such that as the rod 82 is pulled in the direction away from lever 62 causing the angle between rod 82 and lever 62 to increase from the neutral position of about 90 degrees, at a certain angle the rigid structure 110 will be in physical contact with the guide member 45, as shown in FIG. 5D in the solid lined position, which will prevent further increase in angle without disconnecting member 103 from the other linkage portion and therefore de-linking the control linkage. Continued pulling of the rod 82 along the same direction will cause decoupling of the linkage. This mechanism isolates and therefore protects the control surface and associated structures from excessive tension present in the control linkage.

Figure 6:
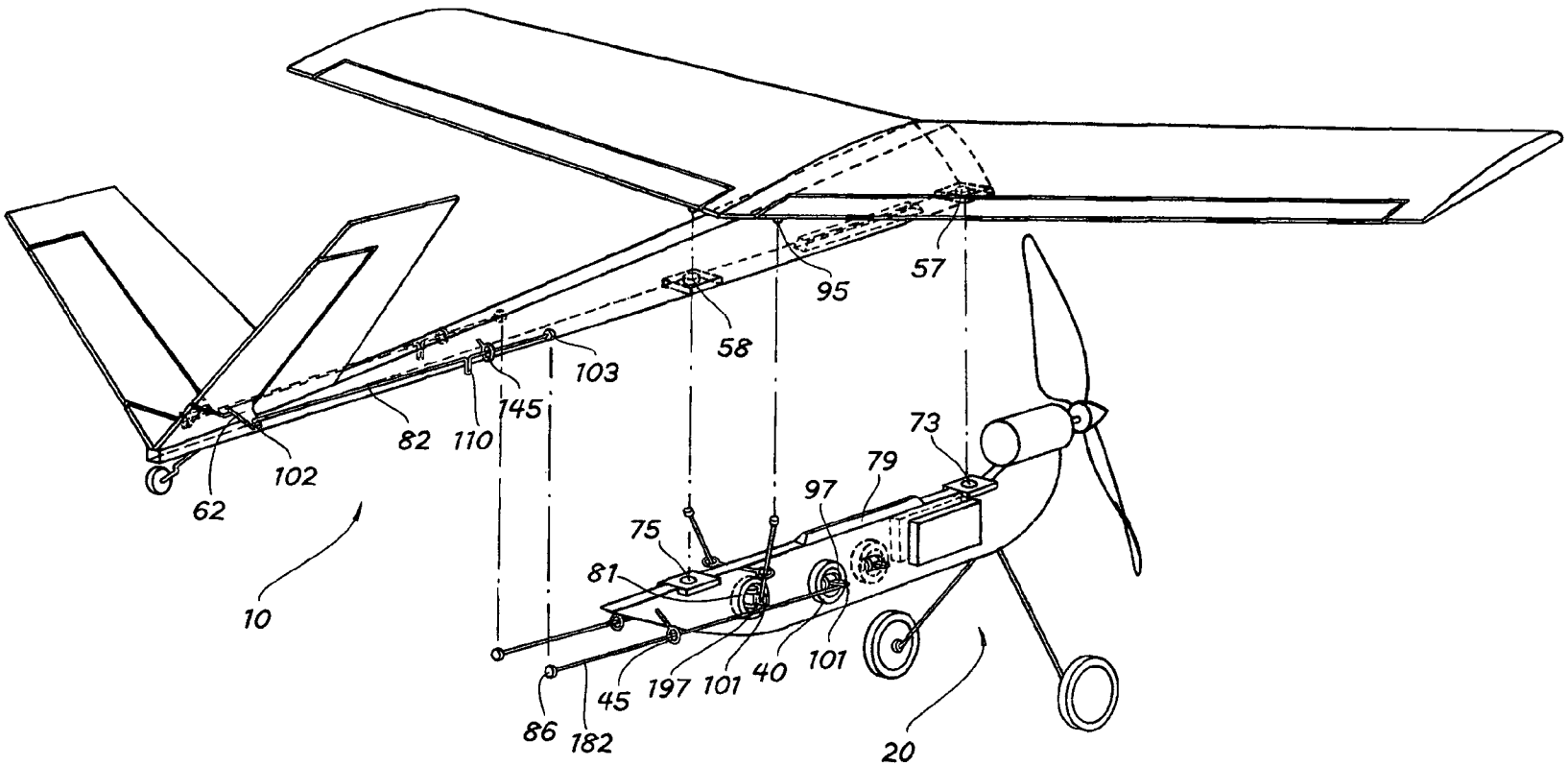
FIG. 6 is an exploded perspective view of a modularized airplane embodying the current invention employing alternative embodiments of the inter-modular structural connection means and control linkage means from that shown in FIG. 1 and FIG. 2.
Figure 7:
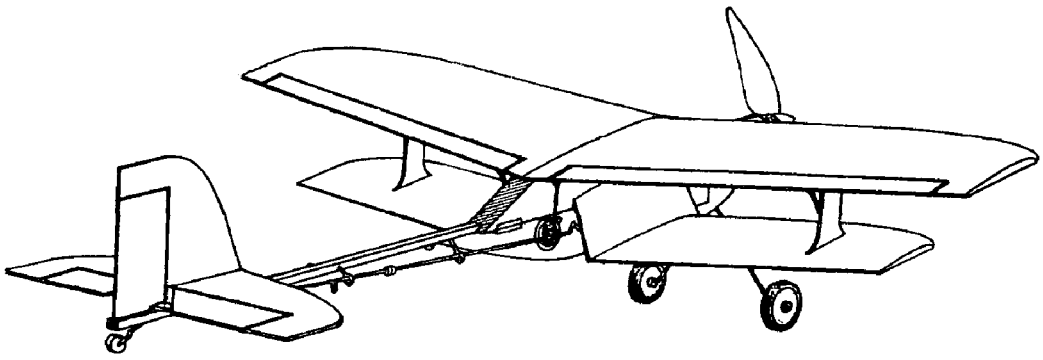

Referring now to FIG. 6, an alternative embodiment of the modularized airplane is disclosed, in which control linkages for the tail control surfaces and for the ailerons are based on the alternative embodiment revealed in FIGS. 4G and 4C, respectively, the means for isolating the control surface from excessive pulling tension for the tail control surface linkages and for the aileron linkages are based on the alternative embodiment disclosed in FIG. 5D and FIG. 5B, respectively. This embodiment has the advantages of permitting variable length of the character module 10 and independently variable control surface longitudinal locations.

With reference to FIG. 7, a differing modularized airplane formed with the component module shown in FIG. 6 and a plane module different from the one shown in FIG. 6 is illustrated, which represents one aspect of the advantages represented by current invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A modularized airplane, comprising:

(a) a first module member having a first fuselage portion, at least one aerodynamically functional fin fixedly joined with said first fuselage portion, and at least one flight control surface having a control coupling lever fixedly secured thereon, movably attached to at least one said fin;

(b) a second module member having a second fuselage portion complementary to the first fuselage portion of said first module member (a) in forming an airplane fuselage, support structures provided on said second fuselage portion, a plurality of operatively interconnected essential flight-providing and control-providing components mounted on said support structures including a propulsion device for providing thrust, at least one servo means associated with at least one said at least one flight control surface of said first module member (a) for controlling the angular position of the control surfaces, a device for controlling said propulsion device and said at least one servo means, and power means for powering onboard power consuming components including said propulsion device and said at least one servo means;

(c) a connection means for structurally interconnecting said complementary fuselage portions of said first module member (a) and said second module member (b) to ensure the structural and aerodynamic integrity of the integral modularized airplane, includes at least one pair of mutually magnetically attractive and operatively matching members connectable to one another by said mutual magnetic attraction force, and affixed oppositely at predetermined locations on said first module member (a) and said second module member (b), the magnitude of said magnetic attraction force is selected for the inter-modular structural connection to withstand the modularized airplane structure-wise stress under allowed operation conditions, as well as to enable structurally nondestructive disconnection of the modularized airplane into structurally separated individual module members under excessive structural stress;

whereby, when said first module member and said second module member are brought to a spatial proximity where at least one pair of said magnetically attractive members experience sufficient mutual magnetic attraction to result in progressive pair-wise connection, substantial automatic modular structural interconnection occurs, and said module members disconnect from one another nondestructively under inter-modular structural stress exceeding said selected magnitude;

(d) a linkage means for operatively interconnecting said at least one flight control surface of said first module member (a) and associated said at least one servo means of said second module member (b) for transmitting control motion from said at least one servo means to said at least one flight control surface, allowing excessive-linkage-stress-induced nondestructive linkage disconnection;

whereby, said linkage means (d) and said connection means (c) together enable a modularized airplane to be formed by connecting the control linkage between said modules (a and b) and structurally connecting said modules (a and b) substantially automatically by said magnetic attraction force, and such modularized airplane may be intentionally or unintentionally disassembled nondestructively into separate modules (a and b) by simply applying excessive parting force between the modules (a and b) to separate the modules structurally and to disconnect the control linkage between the modules;

whereby, both said module members can incorporate differing styles and aerodynamic characteristics to form differing airplanes.

2. The modularized airplane of claim 1, wherein said connection means (c) further includes two mutually physically matching and laterally interlocking structure sections provided oppositely at predetermined locations on said first module member (a) and said second module member (b), adapted to be in mutually matching and interlocking position when said first module member (a) and said second module member (b) are structurally interconnected;

whereby, one said structure section forms a physical acceptance for said matching structure section allowing progressively smaller lateral misalignment between said two opposing magnetically attractive members in each of said pairs as the mutually magnetically attractive members in said pairs approaching progressively closer to one another;

whereby, said two structure sections match and laterally interlock with one another ensuring precise inter-modular structural alignment when said opposing magnetically attractive members in said pairs connect to one another, thus providing guidance and alignment for inter-modular structural interconnection, as well as lateral relative movement limit for interconnected module members.

3. A modularized airplane, comprising:

(a) a first module member having a first fuselage portion, at least one aerodynamically functional fin fixedly joined with said first fuselage portion, and at least one flight control surface having a control coupling lever fixedly secured thereon, movably attached to at least one said fin;

(b) a second module member having a second fuselage portion complementary to the first fuselage portion of said first module member (a) in forming an airplane fuselage, support structures provided on said second fuselage portion, a plurality of operatively interconnected essential flight-providing and control-providing components mounted on said support structures including a propulsion device for providing thrust, at least one servo means associated with at least one said at least one flight control surface of said first module member (a) for controlling the angular position of the control surfaces, a device for controlling said propulsion device and said at least one servo means, and power means for powering onboard power consuming components including said propulsion device and said at least one servo means;

(c) a connection means for structurally interconnecting said complementary fuselage portions of said first module member (a) and said second module member (b) to ensure the structural and aerodynamic integrity of the integral modularized airplane, and allowing structurally nondestructive disconnection of the modularized airplane into structurally separated individual module members under inter-modular structural stress exceeding a predetermined limit;

(d) a linkage means for operatively interconnecting said at least one flight control surface of said first module member (a) and associated said at least one servo means of said second module member (b) for transmitting control motion from said at least one servo means to said at least one flight control surface, includes a first linkage portion and a second linkage portion, coupling means provided for said first linkage portion to operatively couple to said servo means, another coupling means provided for said second linkage portion to operatively couple to said control surface associated with said servo means, a pair of mutually magnetically attractive and operatively matching members affixed at predetermined locations on said first linkage portion and said second linkage portion, respectively, for connecting said two linkage portions to form one linkage assembly member operatively linking said control surface and said associated servo means, the magnitude of said mutual magnetic attraction force is selected for said one linkage assembly member to withstand the modularized airplane control-linkage-wise tension under allowed operation conditions, as well as to enable nondestructive disconnection of said linkage assembly member into said linkage portions under excessive control-linkage-wise tensions;

whereby, when first linkage portion and a second linkage portion are brought to a spatial proximity where said pair of mutually magnetically attractive and operatively matching members experience sufficient mutual magnetic attraction to result in progressive pair-wise connection, substantial automatic control linkage connection occurs to forming said linkage assembly member, and said linkage assembly member disconnects nondestructively into said linkage portions under excessive control-linkage-wise tensions;

whereby, said linkage means (d) and said connection means (c) together enable a modularized airplane to be formed by connecting the control linkage between said control surface in modules (a) and said associated servo means in module (b) substantially automatically by said magnetic attraction force, and structurally connecting said modules (a and b), and such modularized airplane may be intentionally or unintentionally disassembled nondestructively into separate modules (a and b) by simply applying excessive parting force between the modules (a and b) to separate the modules structurally and to disconnect the control linkage between the modules;

whereby, both said module members can incorporate differing styles and aerodynamic characteristics to form differing airplanes.

4. The modularized airplane of claim 3, wherein said linkage means (d) further includes a linkage guide means for limiting the spatial orientation for said linkage portions so that, when said first module member (a) and said second module member (b) are connected by connection means (c), said two mutually magnetically attractive members will be positioned sufficiently near one another to result in substantial automatic connection of said two linkage portions by magnetic attraction force, thus forming said one control linkage assembly.

5. The modularized airplane of claim 4, wherein said linkage guide means of said control linkage means (d) includes a rigid guide member for each of said linkage portions, said guide member has a through hole forming an aperture through which said linkage portion extends, said guide member is mounted on the same module member having said one control surface or one servo means said linkage portion is linked to, and the size and shape of said aperture are adapted not to obstruct linkage transmission of control motion.

6. The modularized airplane of claim 4, wherein said one linkage assembly further includes:

a first structure, rigid, provided or extending from a predetermined location on said one linkage member;

a second structure, rigid, provided on or extended from said first module member in physical relationship with said first structure forming a longitudinal movement limit for said one linkage assembly member and therefore forming a limited operating range for said at least one control surface;

whereby, upon reaching said longitudinal movement limit said first structure is in physical contact with said second structure, thus preventing said one linkage assembly from further longitudinal movement, and further longitudinal movement of the first linkage portion will cause said first linkage portion to disconnect from second linkage portion.

7. A combination comprising:

(a) a modularized airplane having two interconnectable modules, the first module having a fuselage portion, at least one aerodynamically functional fin fixedly joined with said fuselage portion and a flight control surface having a control lever fixedly secured thereon and movably attached to a said at least one fin, the second module having a fuselage portion complementary to the fuselage portion of said first module having support structures provided thereto, a set of operatively interconnected airplane flight components sufficient for airplane operation mounted on said support structures including at least one servo device;

(b) for linking said at least one servo device to said flight control surface, a separable control linkage assembly, comprising:

a first linkage member having a first coupling end and a second coupling end, said first coupling end operatively connectable to said servo device;

a second linkage member having a first coupling end and a second coupling end, said first coupling end operatively connectable to said flight control surface;

at least one guide member having an aperture through which one of said linkage members extends;

said second coupling end of said first linkage member and said second coupling end of said second linkage member are mutually magnetically attractive and separably connectable to one another by mutual magnetic attraction force for linking said first linkage member to said second linkage member to form one linkage assembly;

said mutual magnetic attraction force sustaining the connection of said first linkage member to said second linkage member having a strength sufficient for the linkage connection to withstand the linkage stress under allowed airplane operation conditions without disconnection and to disconnect before the linkage parting stress reaches the level destructive to connected linkage members;

said aperture having a shape and size defining a limited transverse spatial region for said linkage member extending through said aperture while not obstructing linkage motion transmission, therefore forming a limited spatial region for said mutually magnetically attractive ends of said first and second linkage members, in which said mutually magnetically attractive ends are sufficiently close to one another to experience sufficient mutual magnetic attraction to result in connection of said first and second linkage members to form one linkage assembly;

(c) connection means for structurally connecting said first module and said second module to form an airplane, and for disassembling the airplane into separate said first module and said second module.

8. The combination of claim 7, wherein said set of interconnected airplane flight components further includes a propulsion unit for providing thrust, electronics circuitry for controlling said servo device and said propulsion unit, a power supply means for powering onboard power consuming components including said at least one servo device and said propulsion unit.

9. The combination of claim 7, wherein said connection means (c) comprises at least one pair of mutually magnetically attractive members connectable to one another by attractive magnetic force, affixed oppositely at predetermined locations on said first module and said second module for connecting said first module to said second module, having the magnetic force strength sufficient for the connection to withstand the stress under allowed airplane operation conditions without disconnection and to disconnect before the parting stress between connected modules reaches the level destructive to the connected modules.

10. The combination of claim 9, further comprises at least one set of two mutually physically matching and laterally interlocking structure sections provided oppositely at predetermined locations on said first module and said second module, adapted to be in mutually matching and interlocking position when said first module and said second module are interconnected, one of said two structure sections having a hollowed shape, wider at the opening, forming a physical acceptance for the other of said two structure sections for providing guidance for interconnecting said modules, and for preventing lateral relative movement between the connected modules.

11. The combination of claim 9, further comprises:

a first structure, rigid, provided or extending from a predetermined location on said separable control linkage assembly;

a second structure, rigid, provided in said first module in physical relationship with said first structure forming a longitudinal movement limit for said one linkage assembly and therefore forming a limited operating range for said control element;

whereby, upon reaching said longitudinal movement limit said first structure is in physical contact with said second structure, thus preventing said one linkage assembly from further longitudinal movement, and further longitudinal movement of the first linkage member will cause said first linkage member to disconnect from second linkage member.

* * * * *